US007404551B2

(12) United States Patent
Brown et al.

(10) Patent No.: US 7,404,551 B2
(45) Date of Patent: Jul. 29, 2008

(54) STACK QUALITY MONITORING ALGORITHM

(75) Inventors: Robert H. Brown, Hamilton (CA); Raymond M. Ruthenberg, Toronto (CA); Wayne R. Jordan, London (CA); Richard Biasutto, Milton (CA); Michel Loiselle, Brampton (CA); Perry C. Dong, Etobicoke (CA); Mathieu King, Toronto (CA)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 11/258,716

(22) Filed: Oct. 26, 2005

(65) Prior Publication Data

US 2007/0090584 A1 Apr. 26, 2007

(51) Int. Cl.
*B65H 37/04* (2006.01)

(52) U.S. Cl. ..... 270/58.13; 270/52.06; 270/58.02; 270/58.03; 270/58.09; 270/58.19; 270/58.28

(58) Field of Classification Search ..... 270/52.06, 270/58.02, 58.03, 58.09, 58.13, 58.19, 58.28
See application file for complete search history.

(56) References Cited

U.S. PATENT DOCUMENTS

| | | | | | |
|---|---|---|---|---|---|
| 4,402,387 | A * | 9/1983 | Tsuji et al. | ..... | 187/293 |
| 4,815,725 | A * | 3/1989 | Kanaya | ..... | 271/258.01 |
| 4,919,410 | A * | 4/1990 | Robinson et al. | ..... | 399/45 |
| 4,976,421 | A * | 12/1990 | Kanaya | ..... | 271/258.01 |
| 5,137,265 | A * | 8/1992 | Sato et al. | ..... | 270/58.12 |
| 5,207,416 | A | 5/1993 | Soler | | |
| 5,385,340 | A * | 1/1995 | Hiroi et al. | ..... | 270/58.13 |
| 6,145,826 | A * | 11/2000 | Kawata | ..... | 270/58.28 |
| 6,296,247 | B1 * | 10/2001 | Tamura et al. | ..... | 271/214 |
| 6,302,389 | B1 * | 10/2001 | Kato et al. | ..... | 270/58.13 |
| 6,315,288 | B1 * | 11/2001 | Sugishima et al. | ..... | 271/303 |
| 6,583,891 | B2 * | 6/2003 | Joyce | ..... | 358/1.18 |

* cited by examiner

*Primary Examiner*—Gene O. Crawford
*Assistant Examiner*—Leslie Nicholson, III
(74) *Attorney, Agent, or Firm*—William A. Henry, III

(57) ABSTRACT

An improved method for monitoring stack quality in a finisher of a printer includes examining the net displacement of a compiling tray after each set has been ejected. A deviation from the normal increments of displacement for each set triggers a "tray full" condition which alerts a user to empty the tray.

7 Claims, 4 Drawing Sheets

STACK QUALITY MONITORING ALGORITHM

Cross reference is hereby made to commonly assigned U.S. Publication No. 20070090583 entitled SLOPED STACK DETECTION SENSOR AND ALGORITHM by Robert Brown et al.

This invention relates in general to an image forming apparatus, and more particularly, to an image forming apparatus employing an improved finisher.

In typical multi-function finishers, a routine is employed that uses a cross beam sensor that includes an emitier 57 and a receiver 58 as shown in FIG. 1 to detect the height of the highest point in a stack across the beam and define the stop position of the main tray of the finisher when moving in the upward direction to a compiling position following the ejection of a completed set, as shown in FIG. 2. Presently, there is no way to determine whether or not an ejected set has properly settled to the backwall of the tray. It is possible for sets sent to the main tray to fail to settle to the backwall. This defeats the through beam sensor and results in improper main tray height positioning. That is, with the finished sets staggered the cross beam sensor will be open until it is blocked by a sheet set that is below the top set(s) in the stack, thus stopping the main tray at an improper compiling position making the top of the stack too high. Because the top of the stack will be at the wrong height, an incoming sheet set can contact the top of the stack and either push the top sets onto the floor or jam the machine.

Stack height sensing in general is known, for example, in U.S. Pat. No. 5,207,416 by Solar an apparatus is shown in which a stack of sheets is detected at a preselected location by the use of a pressure transducer that is enabled to transmit a signal indicative of the absence of the stack of sheet at the preselected location in response to an air jet impacting thereon. However, sensors of this type are of no help in improving cross beam sensors toward detecting whether stapled sheet sets have properly set against a stacker tray backwall.

Accordingly, an improved stack quality monitoring system is disclosed that includes examining the net displacement of the compiling tray after each set has been ejected. A deviation from the normal increments triggers a "tray full" condition which alerts a user to empty the tray.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefore, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein:

FIG. 1. is a partial, schematic end view of a prior art multi-function finisher showing a main tray backstop for registering stapled sheet sets and a cross beam sensor.

Figure 1:
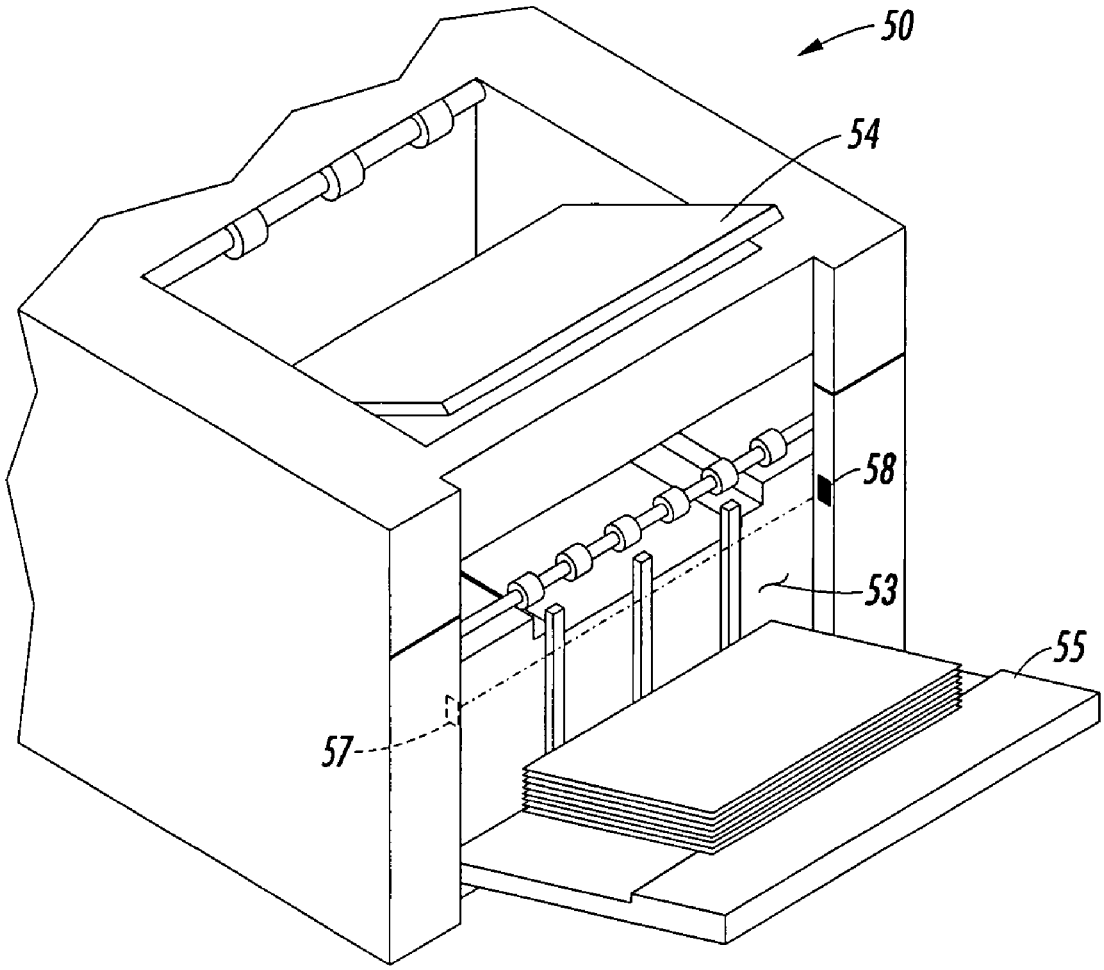
FIG. 1 (PRIOR ART)
Figure 2:
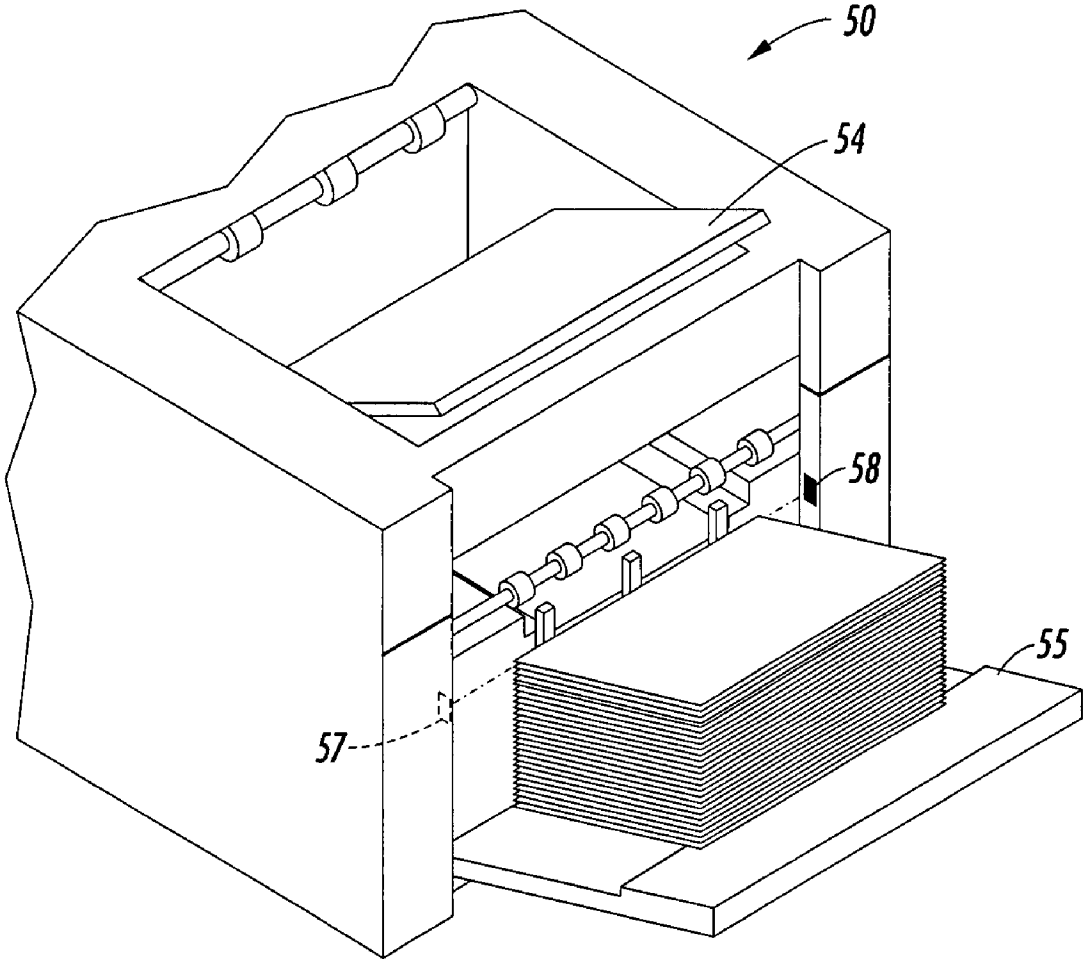
FIG. 2 (PRIOR ART)
FIG. 2 is a prior art, partial schematic end view of the multi-function finisher of FIG. 1 showing the cross beam sensor blocked by a partial or completed sheet set.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Figure 3:
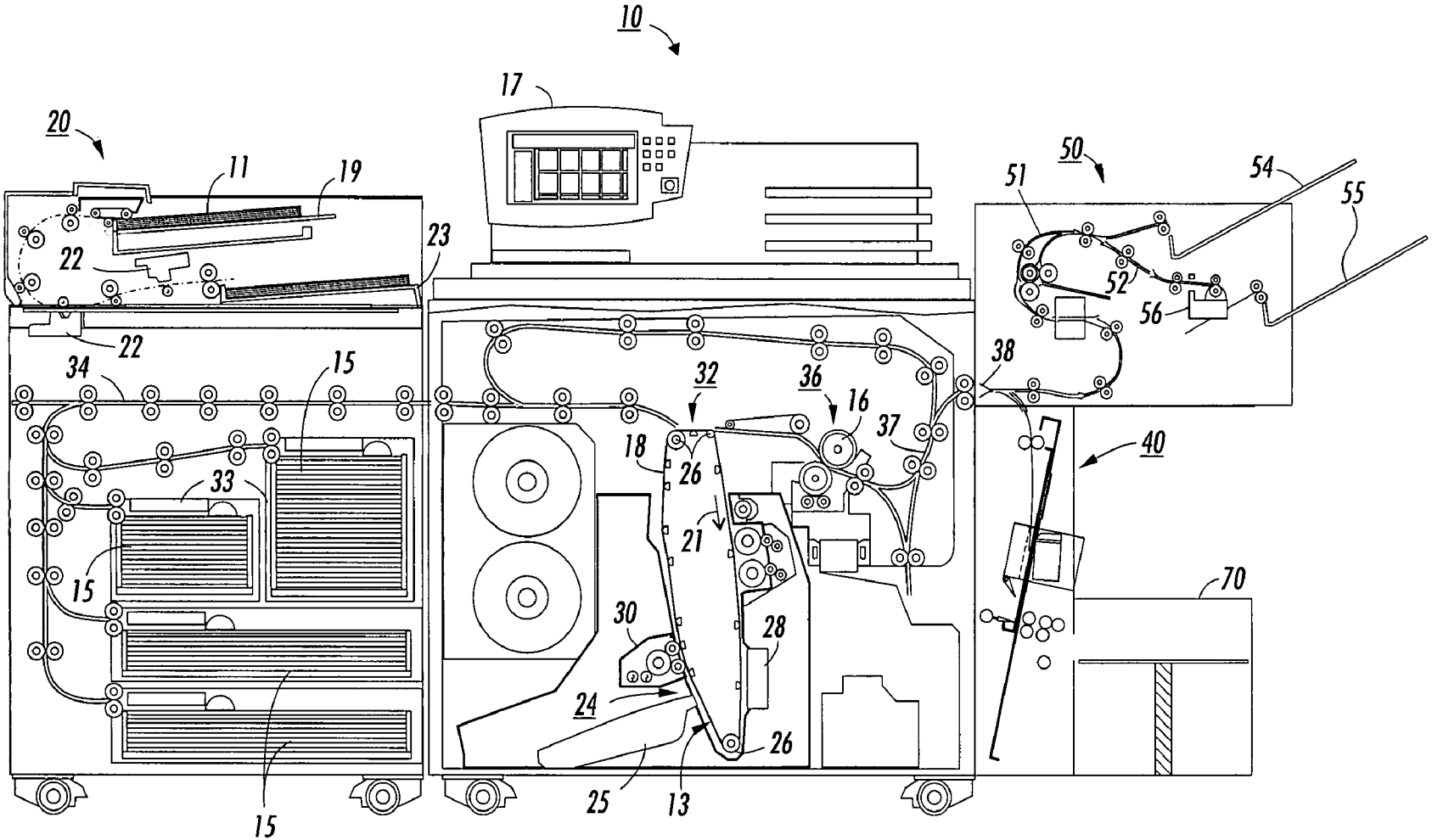
FIG. 3 is an exemplary elevation view of a modular xerographic printer that includes an exemplary stack quality monitoring system in accordance with the present disclosure.

Referring to the FIG. 3 printer 10, as in other xerographic machines, as is well known, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toned image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to a multi-function finishing station 50.

With further reference to FIG. 3, a simplified elevation view of multi-functional finisher 50 is shown including a modular booklet maker 40. Printed signature sheets from the printer 10 are accepted at an entry port 38 and directed to multiple paths and output trays for printed sheets, corresponding to different desired actions, such as stapling, hole-punching and C or Z-folding. It is to be understood that various rollers and other devices which contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 has a pair of pass-through 100 sheet upside down staplers 56 and is used for most jobs that require stacking or stapling, and the folding destination 40 is used to produce signature booklets, saddle stitched or not, and tri-folded. The finished booklets are collected in a stacker 70. Sheets that are not to be C-folded, Z-folded or made into booklets or do not require stapling are forwarded along path 51 to top tray 54. Sheets that require stapling are forwarded along path 52, stapled with staplers 56 and deposited into the main tray 55. Conventional, spaced apart, staplers 56 are adapted to provide individual staple placement at either the inboard or outboard position of the sheets, as well as, the ability for dual stapling, where a staple is placed at both the inboard and outboard positions of the same sheets.

Figure 4:
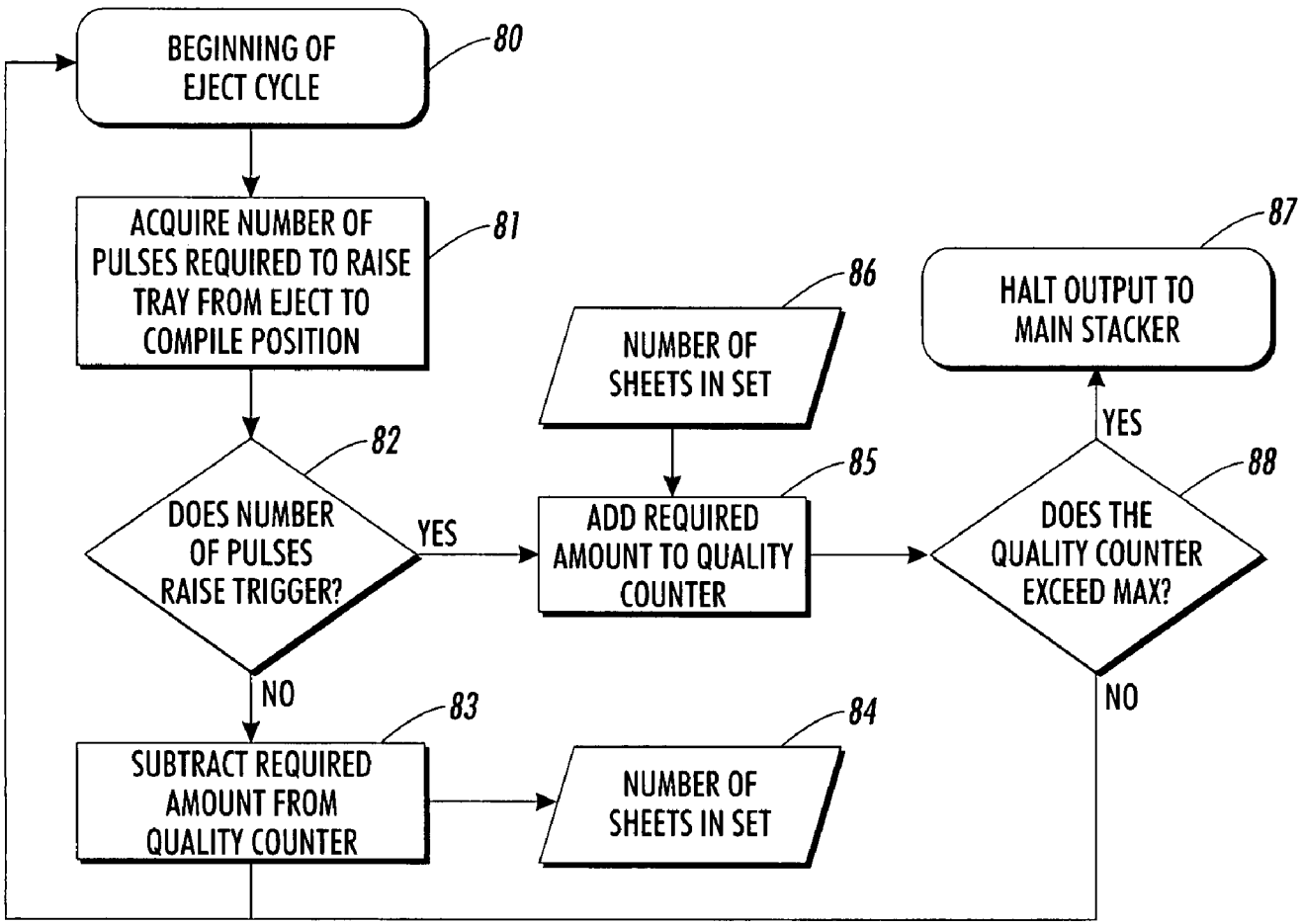
FIG. 4 is block diagram depicting the algorithm used to verify finisher stack quality.

As shown in the block diagram of FIG. 4, and in accordance with the present disclosure, an algorithm for monitoring stack quality is included for detecting whether sheet sets are being registered against backwall 53 or staggered away from the backwall of main tray 55 and examines the net displacement of the tray after each set has been ejected. Knowing the number of sheets in a set, there is a specific distance range that the tray can be reasonably expected to drop from set to set. If the tray height varies unexpectedly, a stacking problem has likely occurred. The most common problem this algorithm detects is the failure of sets to properly settle against the backwall. If a set is ejected and does not fall to the backwall, then the through beam sensor will fail to detect this set and the tray will rise back to the compile position of the previous set. This causes the top of the stack to be too high, and the incoming sheets could contact the top of the stack and either push the top sheets onto the floor or prevent the sheets from exiting, causing a jam in the compiler.

In operation, main tray 55 is elevated into a compiling position to receive a stapled sheet set due to actuation of a conventional elevator system (not shown) that includes a belt drive connected to main tray 55 and driven by a conventional motor that has an encoder attached to it. The stapled sheet set is ejected onto main tray 55 after having been stapled with stapler(s) 56. Main tray 55 then lowers and allows the sheet set to self register against backwall 53. In order to determine when a failure has occurred, the tray elevator motor's encoder is monitored while the tray is raised from the set eject position to the compile position.

TABLE 1

Counter Update Chart

| Set Size (Sheets) | Condition Required for Trigger | Amount Added in Triggered Case | Amount Subtracted in Acceptance Case |
|---|---|---|---|
| 1-4 | 310 encoder pulses | 190 | 50 |
| 5-50 | 310 encoder pulses | 560 | 65 |
| 51-89 | 330 encoder pulses | 850 | 85 |
| 90-100 | 480 encoder pulses | 950 | 100 |
| 90-100 | Tray Does Not Rise After Eject | 500 | N/A |

A failure has occurred when one of the conditions listed in Table 1 arises. A counter is maintained to keep track of the stack quality, and updated according to a weighted failure criteria shown in Table 1. This criteria puts more emphasis on large failed sets and less on small sets. Once the quality counter count exceeds a predetermined level, e.g., 1000, the stack quality has deteriorated to a dangerous level and output to the main tray is halted. For example, with a set size of between 1-4 sheets, as the tray rises from the set eject position to the compile position, pulses sent by the encoder are counted and if they are below 310 pulses an amount of 50 counts is subtracted from the quality counter count and the finisher continues to operate. If the encoder pulse count had been 310 or above, an amount of 190 counts would have been added to the quality counter count. If the additional 190 counts would not push the total quality counter count over 1000 the finisher would continue to operate. However, if the additional 190 counts would have pushed the quality counter count over 1000, output to the main tray would have been halted.

Alternatively, for a set of sheets from 90 to 100, the encoder pulse count that triggers adding 950 quality counter counts is 480, while an encoder pulse count of less than 480 would be in an acceptable range and a count of 100 would be subtracted from the quality count. Also, for this set of sheet size, if the tray does not rise at all after a set has been ejected the quality count will increase by 500. If either of the heretofore mentioned added or subtracted quality counter counts would leave the quality counter count at 1000 or above, output to the main tray is stopped for the user to empty or rearrange the sets in the tray.

The algorithm exercised in Table 1 is shown in FIG. 4 and commences with the beginning of the eject cycle in block 80. In block 81, the number of pulses required to raise main tray 55 from an eject position to a compile position is counted. If, as shown in decision block 82, the answer is NO (the number of pulses does not meet the requirement for a trigger), the required amount in Table 1 is subtracted from the quality counter in block 83 based on the number of sheets in the ejected set in block 84. Thus, the quality counter does not exceed the predetermined maximum in block 88 and output to the main tray is continued. If, however, the decision in block 82 is YES, the required amount of Table 1 is added to the quality counter in block 85 based on the number of sheets in the set as shown in block 86 and the decision is made in block 88 as to whether or not the quality counter exceeds the predetermined maximum. If it does not, the output to the main tray is continued, but if it does exceed the predetermined maximum, output is halted to the tray as shown in block 87.

In recapitulation, an algorithm is disclosed for finishers that verifies stack quality and advises the user to empty the tray. The algorithm examines the net displacement of the tray after each set has been ejected. A deviation from the normal increment increases the quality counter count. When the count is over 999 the "tray full" condition is raised. After the customer has emptied the tray the counter is reset. The algorithm can be adapted to various set conditions, e.g., providing stricter control for thicker sets.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A stack quality monitoring method for use in a printing apparatus, comprising:

providing a scanning member positioned to read images on documents positioned thereover and forward image data for further processing;

providing an image processor that receives the image data from said scanning member and processing it;

providing at least one copy sheet feed tray adapted to feed copy sheets to receive images thereon from said image processor;

providing a finisher for producing sets from said copy sheets, said finisher including an output tray;

counting the number of pulses required to raise said output tray from an eject position to a compile position;

determining if the number of pulses counted is above a threshold number;

adding a predetermined number of pulse counts to the pulse count based on the number of sheets in the set if the determined number of pulse counts is above said threshold number;

determining if a predetermined maximum count number has been exceeded; and halting output to said output tray if the predetermined maximum count number has been exceeded.

2. The method of claim 1, wherein said finishing system includes at least two output trays.

3. The method of claim 2, wherein one of said output trays is a main tray.

4. The method of claim 3, including a cross beam sensor positioned to monitor individual sheets and sheet sets ejected onto said main tray.

5. The method of claim 4, wherein said cross beam sensor includes an emitter and a receiver.

6. The method of claim 5, wherein said main tray includes a backwall positioned to promote self registering of said sets ejected into said main tray.

7. The method of claim 1, including subtracting a predetermined number of counts based on the number of sheets in the set from said pulse count number if the determined number of counts is below said threshold number, then continuing ejecting the copy sheet set into said output tray.

* * * * *